United States Patent [19]

Zeilon

[11] 4,362,473

[45] Dec. 7, 1982

[54] ROTARY COMPRESSOR FOR GAS AND LIQUID MIXTURES

[76] Inventor: Sten O. Zeilon, Heimdalsgatan 21, S-260 14 Glumslöv, Sweden

[21] Appl. No.: 151,284

[22] Filed: May 19, 1980

[51] Int. Cl.[3] ..... F04C 19/00

[52] U.S. Cl. ..... 417/68

[58] Field of Search ..... 417/68, 69

[56] References Cited

U.S. PATENT DOCUMENTS 1,611,265 12/1926 Carrey ..... 417/68

4,074,954 2/1978 Roberts ..... 417/68

*Primary Examiner*—Carlton R. Croyle

*Assistant Examiner*—Edward Look

*Attorney, Agent, or Firm*—Eugene E. Geoffrey, Jr.

[57] ABSTRACT

The disclosure relates to a rotary compressor for a gas and liquid mixture and comprising a disk-like rotor disposed in a fixed pump housing and having an annular peripheral gas and liquid channel. The channel includes an annular radially outer space for an entrapped liquid annulus and a radially inner, concentric annular space for gas, which is defined by a liquid trap-forming side wall which penetrates into the liquid annulus space. The gas space is divided into suction and compression chambers by one or more transverse walls connected to the rotor and radially from inwards penetrating into the liquid annulus space, and by planar liquid jets which are deflected from the rotating liquid annulus in the space therefor by means of one or more blades which are fixedly anchored in the pump housing and extend radially along the liquid annulus space.

16 Claims, 6 Drawing Figures

ROTARY COMPRESSOR FOR GAS AND LIQUID MIXTURES

The present invention relates to a rotary compressor for gas and liquid mixtures.

Compressors for the intake of gas and liquid mixtures, separation of the gas from the liquid and compression of the gas, as well as separate discharge of the gas and liquid components are previously known and are used in, for example cooling plants. These prior art compressors are often complicated, expensive and energy-consuming and have a relatively slight flow capacity in relation to their size, cost and energy consumption.

The object of the present invention is to realize a simple, operationally reliable rotary compressor for moderate pressure increases, for example of the order of magnitude of 0.5 bar, and with a relatively large flow capacity. The compressor according to the invention is intended for the simultaneous pumping of a gas and a liquid, and utilizes the through flow of the liquid component for gas sealing and for cooling and lubrication. By means of a method peculiar to the present invention for utilizing the pumped liquid for the above-mentioned functions, a very high degree of simplicity and operational reliability will be attained in the construction.

The compressor according to the invention comprises a rotor disposed in a fixed pump housing and having a peripherally disposed gas and liquid channel, the characterising feature of the compressor according to the invention being that the gas and liquid channel comprises an outer annular space for an enclosed liquid annulus and an inner space concentric therewith for gas, this latter space being laterally defined by a liquid trap-forming side wall which penetrates into the outer annular liquid space, the inner gas space concentric with the liquid space being divided into intake and compression chambers by means of one or more fixed transverse walls carried on the rotor and penetrating into the space for the liquid annulus, and by means of one or more planar liquid jets which are deflected from the rotating liquid annulus by means of one or more blades which are fixedly anchored in the pump housing and penetrate into the space for the liquid annulus.

Thus, the compressor according to the invention comprises a rotor cooperating with a liquid annulus in analogy with prior art liquid annulus pumps, but differs from such pumps on essential points both as regards construction and manner of operation.

In the compressor according to the invention, the rotor and the liquid annulus are rotated concentrically, and the liquid annulus is enclosed in the rotor. Moreover, as a result of substantially complete absence of friction losses between the liquid annulus and the rotor, high speeds and high flow capacity may be attained.

The compression chamber is completely sealed off from the liquid annulus by means of a liquid trap construction as opposed to the situation in liquid annulus pumps which require, for sealing the end walls of the compression chamber, the injection of liquid at higher pressure than the intake pressure for the gas. On the other hand, according to the present invention, gas and liquid can be sucked in at the same pressure. Furthermore, the discharge flow from the compression chamber may be guided by means of a slide device with fixed slides, over which slide outflow ports which may be fixedly disposed in the rotor. As a result, non-return valves are avoided which can occasion operational problems and give rise to high outflow resistance at those high speeds at which the rotor should work. However, according to the present invention valves may be dispensed with entirely. Furthermore, the invention makes use of a novel method of gas pumping, namely a gas compression between a movable lamella carried on the rotor and a stationary liquid wall consisting of a curtain of liquid through which the lamella may readily pass.

The nature of the present invention and its aspects will be more readily understood from the following brief description of the accompanying drawings which schematically illustrate two embodiments of the invention, and discussion relating thereto.

Figure 1:
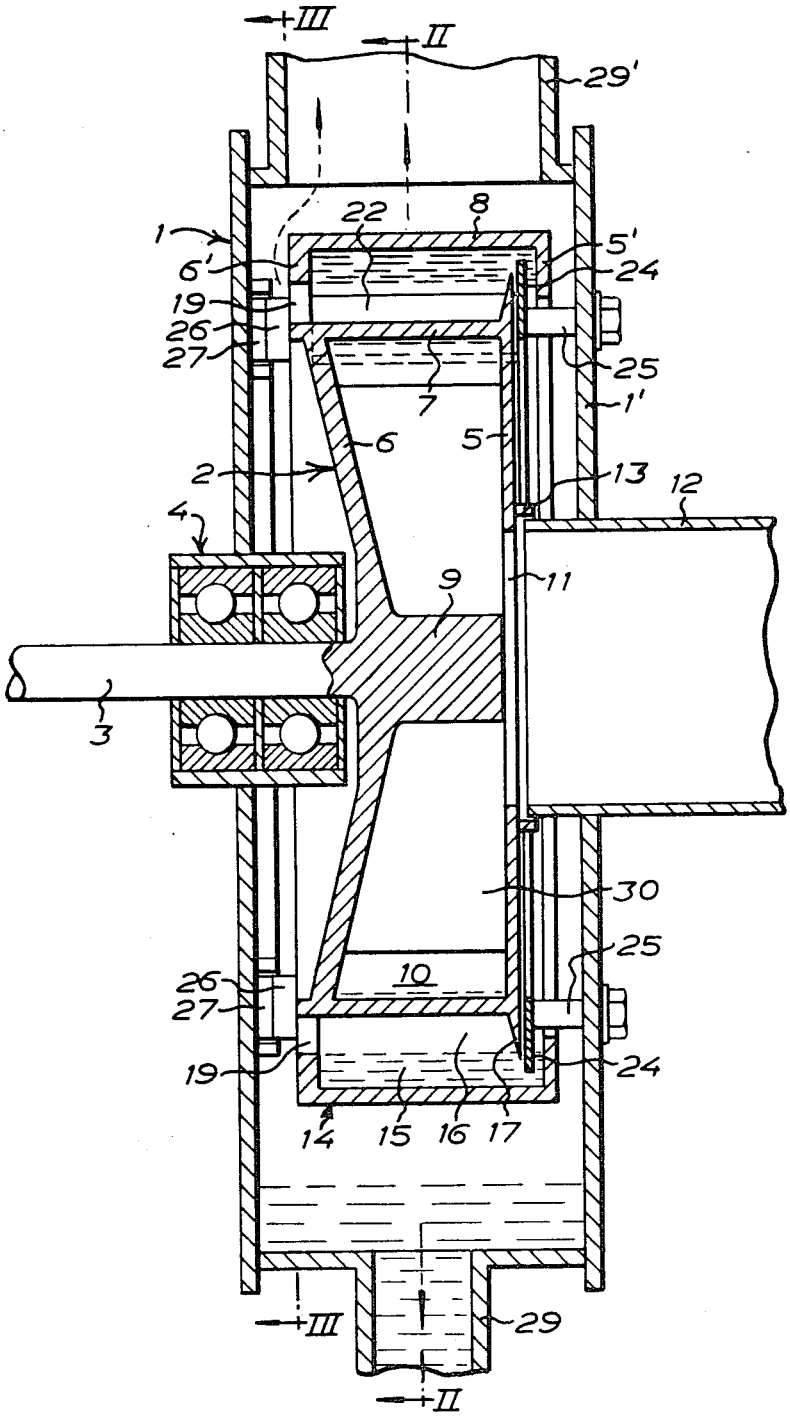
FIG. 1 shows one embodiment of the compressor according to the invention in axial section along the line I—I in FIG. 3.
Figure 2:
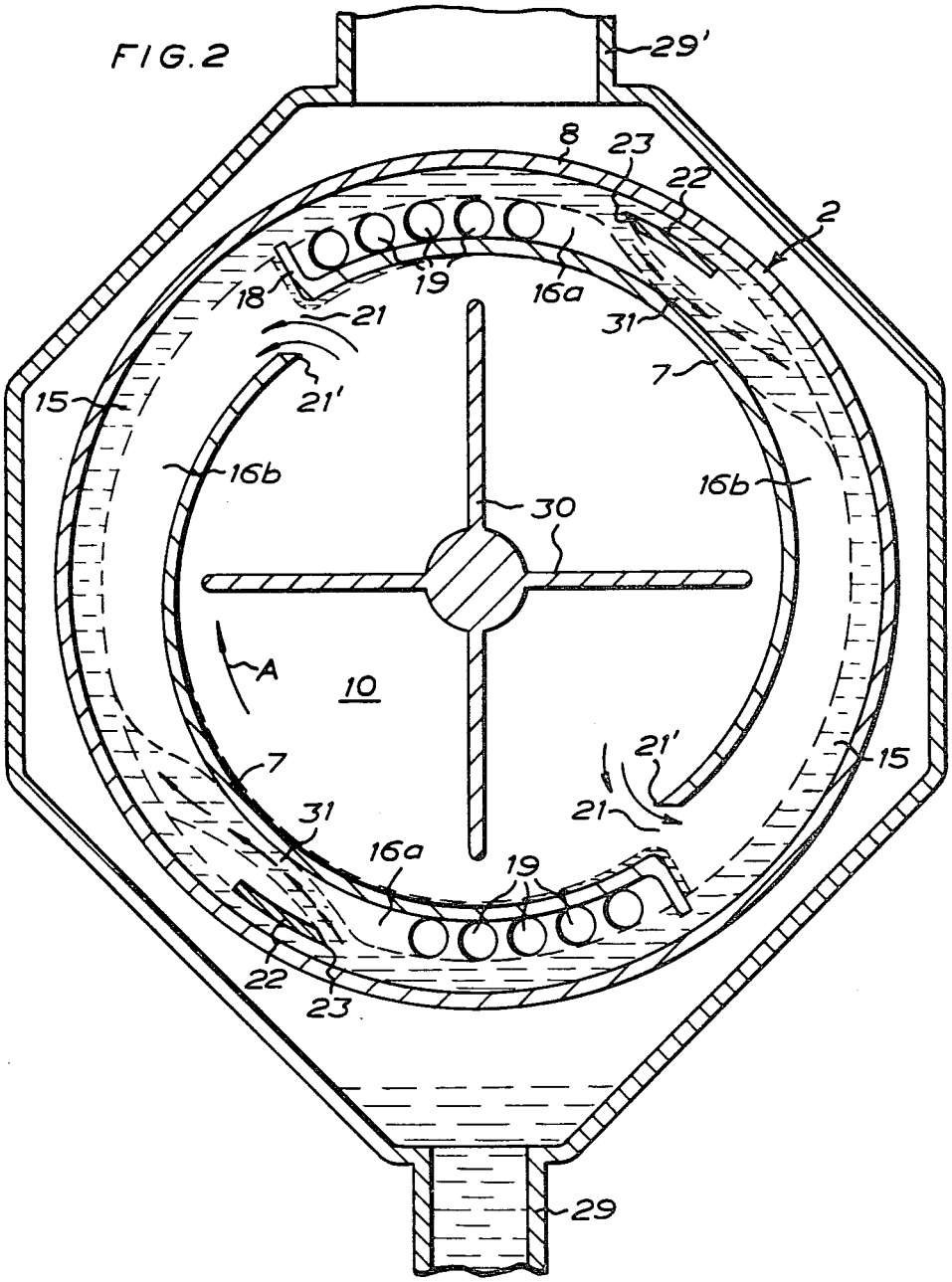
FIG. 2 is a cross-section of the compressor taken along the line II—II in FIG. 1 and shows, in particular, the liquid annulus with two stationary liquid jets.
Figure 3:
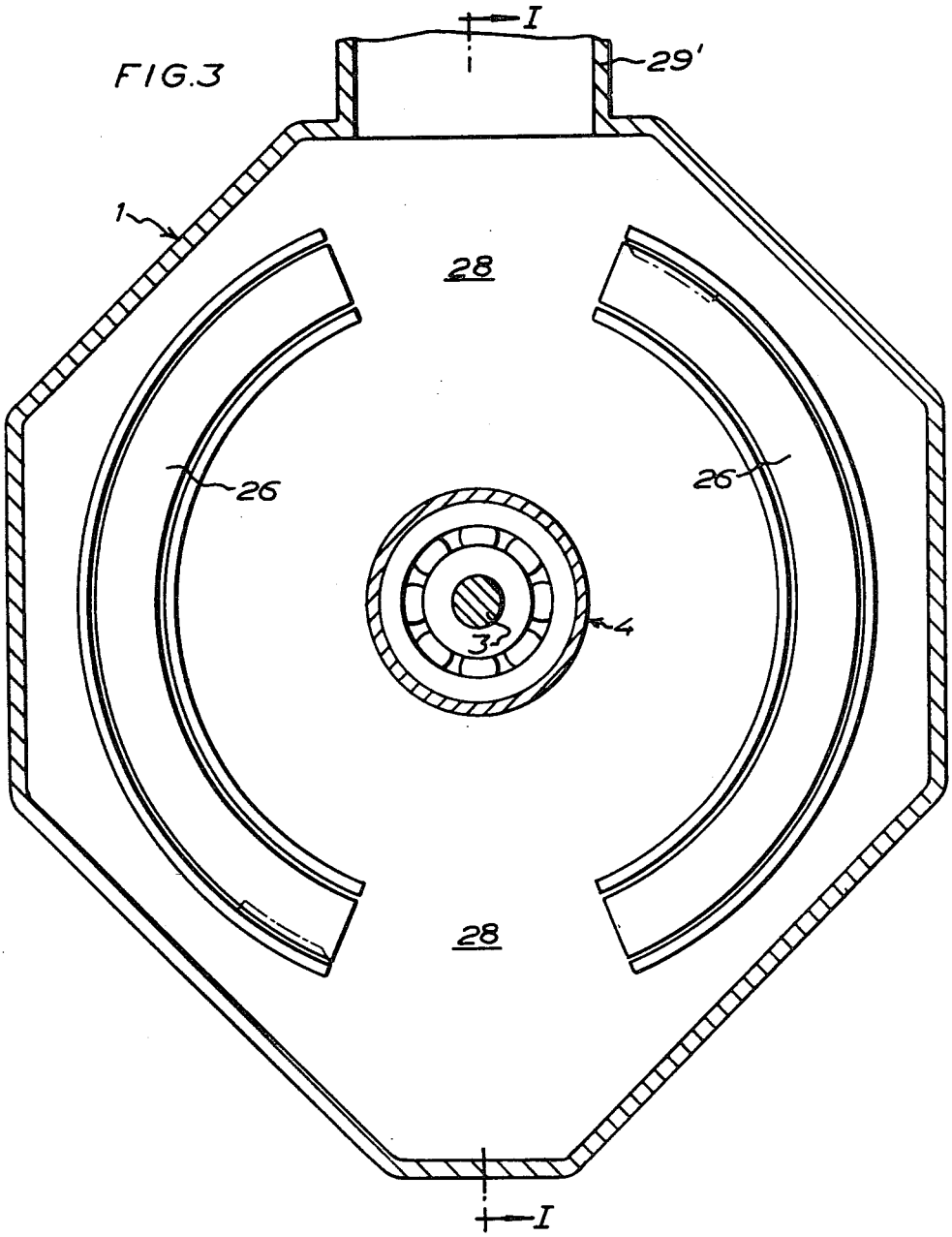
FIG. 3 shows the compressor in cross-section taken along the line III—III in FIG. 1 and shows, in particular, the slide valve surfaces of the compressor.

The embodiment illustrated in FIGS. 1—3 comprises a fixed pump housing 1 in which a rotor 2 is rotatably supported on a central drive shaft 3 which is journalled and sealed in a fixed journal and stuffing box 4. The rotor 2 is in the form of a wheel and comprises two opposed axially spaced side walls 5, 6 and double, coaxial circumferential walls 7, 8. The side walls and inner circumferential wall 7 of the rotor, as well as the rotor hub 9 define an enclosed annular central cavity 10, to which is connected a central intake orifice 11 through one side wall 5 and an inlet channel 12 connected to the orifice and extending through a side wall 1' of the pump housing 1 and sealed with respect to the side wall 5 of the rotor by means of an annular sealing 13 which is of low friction for reducing friction losses to a minimum on rotation of the rotor with respect to the sealing.

In the embodiment according to FIGS. 1-3, the outer circumferential wall 8 and the two annular side walls 5' 6' form an annular hub or trough-like construction 14 which periferally surrounds the rotor 2 and is connected therewith, the outer circumferential wall 8 being of axially greater length in a direction to the right with respect to FIG. 1 than the inner circumferential wall 7 so that the outer circumferential wall 8 extends over and axially outwardly from the right-hand side wall 5, the annular side wall 5' lying in a plane which is located an axial distance outwardly from the plane of the side wall 5. The above-described trough-like construction consisting of the walls 5', 6' and 8 defines, with respect to the inner circumferential wall 7, an annular channel 14 which is coaxial with the rotor shaft. The channel 14 is designed as a liquid lock in such a manner that an outer, rotating liquid annulus 15 may be contained within the channel 14, and such that an inner, concentric gas channel 16 is sealed off in that an annular flange 17 connected to the rotor 2 and forming a radial extension of the side wall 5 penetrates into the rotating liquid annulus 15. The radially inner gas channel 16 is thus radially outwardly defined by the liquid in the radially outer liquid annulus 15, and radially inwardly by the inner circumferential wall 7, and is laterally defined by the annular flange 17 and the annular side wall 6'.

The annular gas channel 16 is divided into two separate halves (please see FIG. 2) by means of two radially outwardly projecting lamellae connected to the rotor 2 (and more precisely to the inner circumferential wall 7), the lamellae being in the form of transverse walls 18 which penetrate into the liquid annulus 15 to the same depth as the annular flange 17.

Counting in the direction of rotation A of the rotor 2 there is disposed in the gas channel 16 a series of outflow channels or ports 19 ahead of each transverse wall 18, the ports extending through the annular side wall 6'. Furthermore, behind each transverse wall 18 there is disposed in the inner circumferential wall 7 an inlet channel 21 as a communication between the cavity 10 and the channel 14 which contains the outer liquid annulus 15 and the inner gas channel 16. In the space 15 for the liquid annulus there are fixed two flow deflecting blades 22, the blades being in two diametric positions with respect to each other and consisting of, for example, steel plates having chamfered edges 23 facing the direction of rotation of the rotor. The blades 22 are adapted to the inside of one side wall 6' of the channel 14 and to the end edges of the transverse walls 18, as well as to the annular flange 17, and are supported on an annular disk 24 which penetrates into the liquid annulus 15 between the righthand annular side wall 5' of the channel 14 and the adjacent rotor wall 5 with the annular flange 17 and are connected to the pump housing wall 1' by means of brackets 25.

The annular outer side wall portion 6' of the rotor 2 which is disposed to the left with respect to FIG. 1 and forms the one side wall of the channel 14 also forms a rotary slide which is provided with valve ports consisting of the above-described outflow ports 19, the slide being disposed to rotate adjacent the plane of two arcuate, planar valve surfaces 26 consisting of smoothed disk members, preferably mounted on resilient carriers 27 and consisting of, for example, teflon, these members being shown in plan view in FIG. 3 and in end elevation in FIG. 1. The arcuate valve surfaces 26 which, at adjacent ends, are separated from one another by spaces 28 (please see FIG. 3), have for their object to close the outflow ports 19 and thereby block these against return flow of gas during the compression phases of the compressor (please see the following functional description). When final pressure is attained (maximum pressure for each compression phase) free outflow will, on the other hand, be realized when the discharge mouths of the outflow ports 19 pass both of the diametrically disposed spaces 28 between the adjacent ends of the valve surfaces 26.

It should be observed that FIG. 1 seemingly shows the ports 19 and the fixed valve surfaces 26 on different radial levels because of the fact that FIG. 1 is taken along the section I—I in FIG. 3. In reality, the ports 19 are, naturally, located with their centers on the center line of the surfaces 26.

A mixture of gas and liquid is introduced into the cavity in the rotor 2 through the stationary inlet channel 12. From the pump housing 1, compressed gas and liquid is led off, for example, through a bottom outlet 29 for liquid and a top outlet 29' for gas.

The compressor according to the invention works in the following way.

The mixture of gas and liquid is introduced via the inlet channel 12 and the suction orifice 11 to the cavity 10 in the rotor 2 and a centrifugal and tangential acceleration is imparted to the mixture in the cavity by the rotor. Possibly, the rotor 2 may, for increasing the centrifugal force, be provided with interior, radial vanes 30 in the cavity 10. As a result of the rotation, the liquid is prone to be separated from the gas and be collected on the inside of the inner circumferential wall 7 whence the liquid is led out through the openings 21 in the inner circumferential wall 7 and led out into the annular channel 14 drawing with it the gas. In the channel 14, the liquid is completely separated from the gas and collected as a liquid annulus 15 on the inside of the outer circumferential wall 8. Finally, the liquid is flung out through the ports 19. It should namely be observed that the ports 19 form an overflow for the liquid annulus 15 and regulate the "level" of the liquid annulus, that is to say its radial thickness.

The blades 22 which are located in the field of rotation of the liquid annulus 15 form shares which deflect from the liquid annulus planar liquid jets 31 of high energy in the channel 14, the liquid jets being directed obliquely inwardly towards the inner wall 7 of the gas channel 14. Each jet 31 is aimed back to the liquid annulus 15 by tangential flow towards and deviation by the inner circumferential wall 7. Each jet 31 is stationary in relation to the housing 1 and consists of a curtain of flowing liquid. The stationary jets 31 and the transverse walls 18 rotating together with the rotor divide the gas compartment 16 into two compression chambers **16*a* and two suction intake chanbers 16*b* separating them, the volumes of the chambers alternatingly increasing and decreasing during the rotation of the rotor. The transverse walls 18 realize an entrapment of gas between the liquid annulus 15, the outer circumferential wall 8 and each respective stationary jet 31 and compress the entrapped gas mass in the thus formed compression chambers 16*a*, the compressed gas mass being driven out through the outflow port 19 when these open while each respective transverse wall 18 approaches the jet. It will be readily appreciated that the transverse walls will, during rotation of the rotor 2, pass through the liquid jets 31**.

What is decisive for gas compression ratios which can be attained is the sealing capacity of each respective jet 31 against the walls of the channel 14. Generally speaking, this sealing effect increases, the sharper the deflection and the thicker the liquid jets 31. The deflection and jet thickness are determined by the design of the blades 22 and by the speed which is dependent upon the speed of rotation and diameter of the rotor, as well as by the distance between the liquid annulus 15 and the inner wall 7 of the channel 14, since a pressure difference across the jet would give a deflecting, tangential accelaration in the direction of rotation. In order to utilize a jet 31 with a given kinetic energy of the liquid in an effective manner for acceptable sealing and desired gas compression, both halves of the inner circumferential wall 7 between the openings 21 therein are designed with a radial pitch in a direction rearwardly against the direction of rotation from the rear edge 21' of each respective opening 21 along a certain distance, such that the gas and liquid channel 14 tapers along a corresponding distance, for example two thirds of the length of each wall half 7, whereafter the curvature of the wall 7 follows a constant radius up to each respective transverse wall 18. As a result, the sealing capacity of the jets 31 increases in union with an increased compression of the gas which is entrapped in the compression chambers 16*a*, 16*b* between the jets and the transverse walls 18.

The outflow ports 19 can advantageously be obliquely bored in the side wall 6' of the channel 14 such that reaction forces of the outflowing gas and liquid are absorbed in the rotor 2.

Modifications of the embodiment according to the invention illustrated in FIGS. 1–3 are possible within the spirit and scope of the invention. The stationary valve surfaces 26 may, for example, be carried on the annular disk 24 which supports the stationary blades 22, the outflow ports 19 being disposed in the righthand side wall 5' of the channel 14 with respect to FIG. 1.

The number of blades 22 and the number of transverse walls 18 (and consequently the number of jets 31 and gas compression chambers 16*a*, 16*b*) may, in principle, be one or more.

The annular flange 17 may, instead of being connected to the rotor 2, be rigidly connected to the pump housing 1 or the inlet channel 12 connected to the pump housing and may constitute an anchorage for the blade of blades 22. Such an embodiment entails, however, sealing problems between the cavity 10 and the gas channel 16 and also between the rotating transverse wall (or walls) 18 and the annular flange 17.

Figure 4:
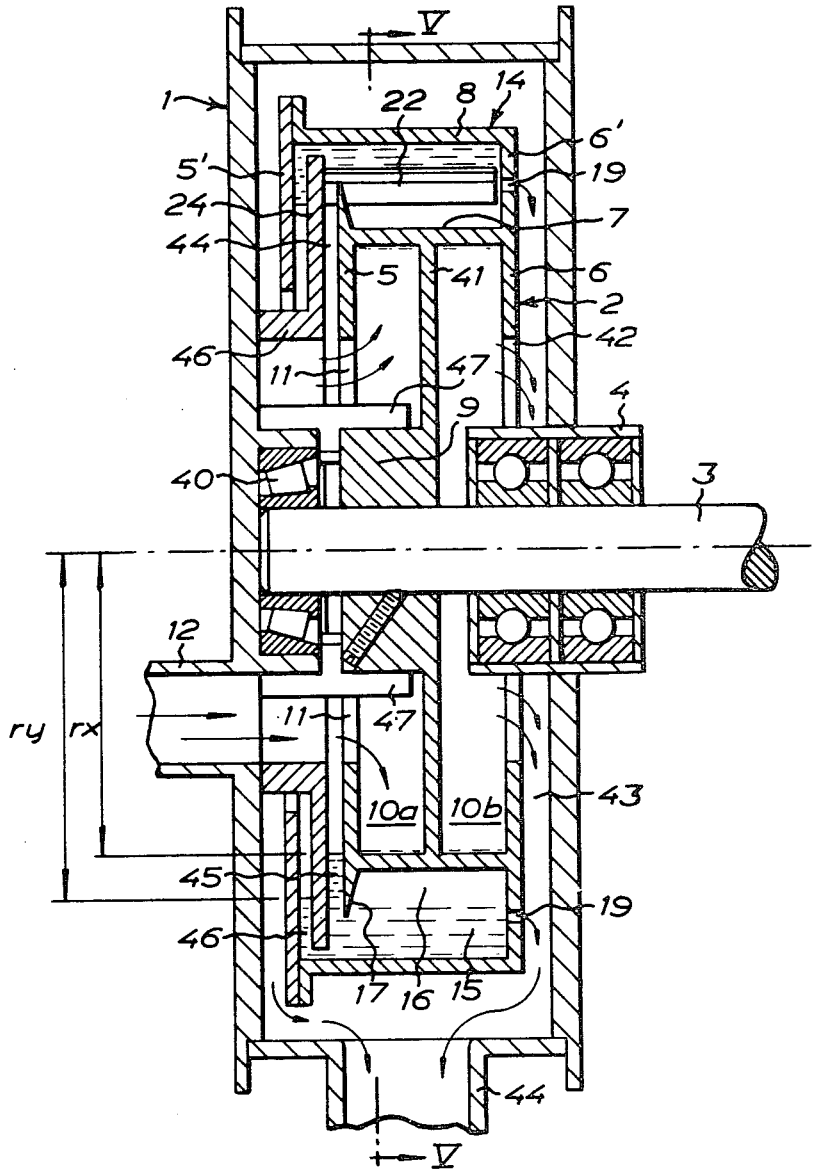
FIG. 4 is a similar view to FIG. 1 showing a modified embodiment of the compressor according to the invention in section taken along the line IV—IV in FIG. 5.
Figure 5:
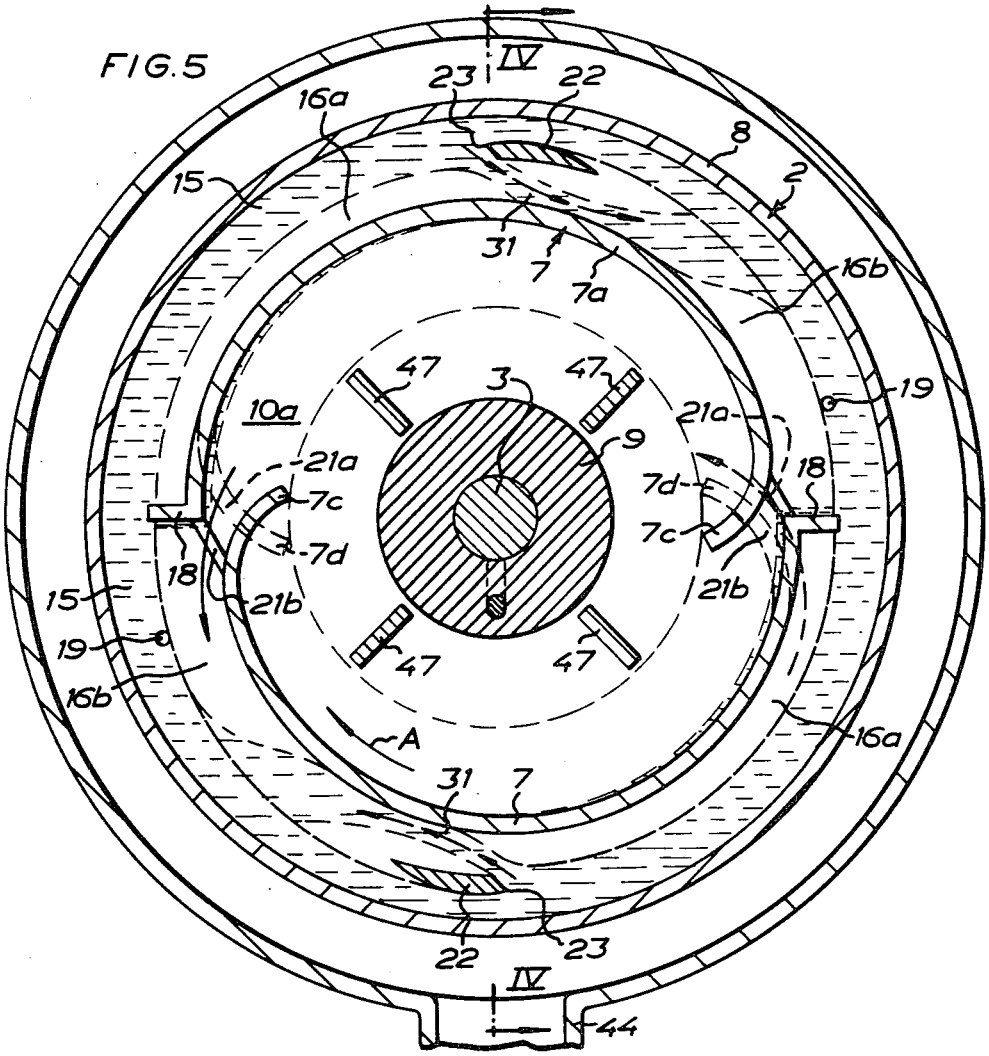
FIG. 5 shows the modified embodiment in a section taken along the line V—V in FIG. 4.
Figure 6:
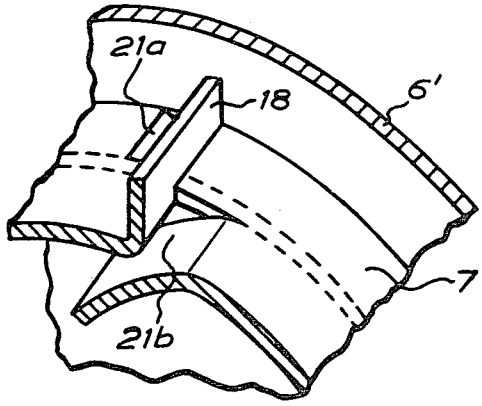
FIG. 6 is perspective view of a portion of the rotor in FIG. 5 in the region of an inlet and an outlet in a circumferential wall of the rotor.

The modified embodiment shown in FIGS. 4–6 constitutes a simplified, preferred embodiment of the compressor according to the invention. In FIGS. 4–6, use is made, as far as is possible, of the same reference numerals as in FIGS. 1–3 for the same or equivalent elements and members.

The rotor shaft 3 is, in this embodiment, journalled within the pump housing 1 in an axial and radial bearing 40 connected to the left-hand pump housing wall and extends out through the right-hand pump housing wall in which the shaft 3 is journalled and sealed in a suitable manner by means of a journal and stuffing box 4. As in the embodiment in FIGS. 1–3, the rotor 2 is secured with its hub 9 on the shaft 3 and consists of side walls 5, 6 and a circumferential wall 7, as well as an outer trough-like construction 14 which, as in the embodiment of FIGS. 1–3, consists of an outer circumferential wall 8 and side walls 5', 6' and which defines, about the inner circumferential wall 7, a channel which, during operation, is divided into an outer liquid annulus channel 15 and an inner gas channel 16', an annular flange 17 connected to the rotor extending through the gas channel 16 to the liquid annulus 15, whose level is determined by one or more outflow ports 19 which, however do not here form valve ports but solely overflow ports determining the liquid level.

The annular cavity in the rotor 2 between the hub 9 and the shaft 2 on one hand and the inner of the two circumferential walls 7, 8 on the other hand is divided into two chambers 10*a*, 10*b* by means of a central partition 41, the inlet channel 2 and the inlet 11 for gas and liquid mixture leading to the left-hand rotor chamber 10*a* with respect to FIG. 4.

The embodiment in FIGS. 4 and 5 is also provided with two blades 22 whose edges 22 are turned to face against the direction of rotation A of the rotor 2. The flow directions of the liquid jets 31 which are stationary with respect to the housing 1 are intimated in FIG. 5 by means of flow arrows drawn in solid lines. The inflow direction for gas and liquid mixture through the inlet 12 to the rotor chamber 10*a* is also intimated, and thence to the suction intake chamber 16*b*. Here, however, compressed gas from the compression chamber 16*a*, 16*b* between the transverse walls 18 and the liquid jets 31 is not led out through valve ports as in the embodiment of FIGS. 1–3, but is led into the right-hand rotor chamber 10*b* through openings in the circumferential wall 7 and is led from the chamber 10*b* via a central opening 42 in the rotor side wall 6 to a space 43 between the wall 6 and the adjacent pump housing wall, where also liquid from the overflow ports 19 is led, and from the pump housing compressed gas and liquid are led out through a common outlet 44. Flows of compressed gas from the compression chambers are intimated by means of flow arrows drawn with broken lines.

The embodiment of FIGS. 4–6 operates without valves and lacks, thus, the slide valve surfaces 26 for cooperation with the ports 19 which exclusively form outlet ports for liquid from the liquid annulus 15 and determine the radial depth of the liquid annulus. The lefthand rotor chamber 10*a* in FIG. 4 forms a low pressure chamber in which the gas and liquid mixture from the inlet channel 12 is led at a relatively low pressure and is flung out through, for example, two outlet orifices 21*a* in the inner circumferential wall 7 to that channel which is formed by the trough-like construction 14. It should be noted that each of the two outlet orifices 21*a* for the gas and liquid mixture from the left-hand chamber 10*a* to the channel in the trough 14 are disposed in but one half of the wall 7 which is located in register with the chamber 10*a*, and, counting in the direction of rotation of the rotor, behind the corresponding transverse wall 18, whereas an orifice 21*b* for compressed gas from each respective compression chamber 16*a* is disposed in the half of the wall 7 in register with the rotor chamber 10*b* ahead of the corresponding transverse wall 18 of the rotor, as is clearly shown in FIG. 6. Compressed gas from each respective compression chamber 16*a* may thus not flow back to the inlet chamber 10*a* of the rotor. No valves are needed, but, if desired, the orifices 21*b* may be provided with spring-loaded nonreturn valves which open at a certain pressure for gas flow from the compression chambers 16*a* to the rotor chamber 10*b*.

Since a relatively low pressure, that is to say inflow pressure of the gas and liquid mixture, prevails in the gap 45 between the rotor wall 5 and the wall 24 which is fixedly secured to the pump housing 1, forms retainers for the cutter 22 and is sealingly connected to the inside of the pump housing at 46, the liquid level from the liquid annulus 15 in the gap 45 rises "higher", that is to say to a smaller radius rx, than to that level ry to which the liquid rises in the gap 46 between the fixed wall 24 and the annular wall 5', which forms a side wall for the trough-like construction 14 of the rotor. In this latter gap 46, the pressure is equal to the pressure of the compressed gas in the pump hosing 1 between the rotor 2 and the inside of the pump housing. The liquid level ry is lower than the level rx and the difference between the liquid levels is equal to the pressure difference between the low pressure (inflow pressure of gas and liquid mixture) and the compression pressure of the gas.

As shown in FIG. 5, the inner circumferential wall 7 has, as in the embodiment of FIGS. 1–3, two transverse walls 18 and two blades 22 and, consequently, two liquid jets 31 and two compression chambers 16*a*, 16*b*. The ports 19 which, in this embodiment serve solely as overflows, are dimensioned in order only to release excess liquid from the liquid annulus 15 and, during operation, the ports 19 are kept full with liquid flowing out from the liquid annulus 15. From the gas and liquid mixture which is collected on the inside of the wall 7 and flows from the low pressure chamber 10*a* through the radial orifices 21*a* to the channel 14, the liquid is separated off by rotation from the gas and collects in the liquid annulus 15, while the gas fills the space between the liquid annulus and the circumferential wall 7. The compressed gas is forced out through the inlet orifices 21*b* in the circumferential wall 7 of the rotor in register with the high pressure chamber 10*b* and flows into this latter chamber. The orifices 21*a* and 21*b* are, in this embodiment, separated from each other by the transverse walls 18 and the rotor wall 41. Wall flaps 7*c*, 7*d* are, as shown in FIG. 5 preferably disposed in register with the orifices 21*a* and 21*b* pairwise obliquely inwardly directed in opposite directions (please see FIGS. 5 and 6) such that the wall flaps 7*c* are directed obliquely inwardly and forwardly in the direction of rotation of the rotor in order, like vanes, to force gas and liquid mixture from the low pressure chamber 10*a* to the trough-like channel construction 14, whereas the flaps 7*d* are directed obliquely inwardly and rearwardly against the direction of rotation in order to lead gas from the compression chambers 16*a* to the high-pressure chamber 10*b* in the rotor 2.

In the embodiment of FIGS. 4–6, the rotor lacks the vanes 30 which were used in the embodiment illustrated in FIGS. 1–3 as centrifugal force increasing means. On the contrary, the pump housing 1 is provided with fixed screen walls 47 within the inlet openings 11 in order to restrict rotation of the gas mixture in the low pressure chamber 10*a*. The walls 47 are, in a suitable manner, connected to the inner side of the pump housing wall and may, if desired, be dispensed with.

The embodiment shown in FIGS. 4–6 may also be modified in various manners without departing from the spirit and scope of the appended claims.

I claim:

1. A rotary compressor for a gas and liquid mixture and comprising a disk-like rotor (2) disposed in a fixed pump housing (1) and having an annular peripheral gas and liquid channel (14), characterised in that the channel (14) includes an annular radially outer space (15) for an entrapped liquid annulus and a radially inner, concentric annular space (16) for gas, which is defined by a liquid trapforming side wall (17) which penetrates into the liquid annulus space (15); and that the gas space (16) is divided into suction and compression chambers (16*b* and 16*a*, respectively) by one or more transverse walls (18) connected to the rotor (2) and extending inwardly toward and penetrating into the liquid annulus space (15), and by planar liquid jets (31) which are deflected from the rotating liquid annulus in the space (15) therefor by means of at least one blade (22) which is fixedly anchored in the pump housing (1) and extends axially along the liquid annulus space (15).

2. The rotary compressor as claimed in claim 1, characterised in that said side wall (17) is rigidly connected to said rotor (2).

3. The rotary compressor as claimed in claim 2, characterised in that the rotor (2) accommodates at least one central cavity (10) with a central inlet opening (11), the central cavity (10) being connected to the annular gas space (16) by means of at least one suction opening (21).

4. The rotary compressor as claimed in claim 1, characterised in that the pump housing (1) is provided with a central inlet channel (11, 12) which is sealingly connected to the cavity (10) in the rotor by the intermediary of a rotary sealing, and has a lower outlet (29) for compressed liquid and an upper outlet (29') for compressed gas.

5. A rotary compressor for a gas and liquid mixture and comprising a disk-like rotor (2) disposed in a fixed pump housing (1) and having an annular peripheral gas and liquid channel (14), characterised in that the channel (14) includes an annular radially outer space (15) for an entrapped liquid annulus and a radially inner, concentric annular space (16) for gas, which is defined by a liquid trap-forming side wall (17) which penetrates into the liquid annulus space (15); and that the gas space (16) is divided into suction and compression chambers (16*b* and 16*a*, respectively) by one or more transverse walls (18) connected to the rotor (2) and extending inwardly toward and penetrating into the liquid annulus space (15), and by planar liquid jets (31) which are deflected from the rotating liquid annulus in the space (15) therefor by means of at least one blade (22) which is fixedly anchored in the pump housing (1) and extends axially along the liquid annulus space (15), said one blade (22) being fixedly secured on an annular disk (24) anchored in the pump housing (1), the disk penetrating into the liquid annulus space (15) in which the blade deflects a liquid jet (31) from the liquid annulus.

6. The rotary compressor as claimed in claim 5, characterized in that a plurality of outflow ports (19) are disposed in a side wall portion (5') which defines the channel (14), and that this side wall portion (5') abuts with a plane slide surface against a surface (26) fixedly connected to the inside of the pump housing (1) and serving as a stationary valve slide.

7. The rotary compressor as claimed in claim 5, characterised in that said side wall (17) is rigidly connected to said rotor (2).

8. The rotary compressor as claimed in claim 7, characterised in that the rotor (2) accommodates at least one central cavity (10) with a central inlet opening (11), the central cavity (10) being connected to the annular gas space (16) by means of at least one suction opening (21).

9. A rotary compressor for a gas and liquid mixture and comprising a disk-like rotor (2) disposed in a fixed pump housing (1) and having an annular peripheral gas and liquid channel (14), characterised in that the channel (14) includes an annular radially outer space (15) for an entrapped liquid annulus and a radially inner, concentric annular space (16) for gas, which is defined by a liquid trap-forming side wall (17) which penetrates into the liquid annulus space (15); and that the gas space (16) is divided into suction and compression chambers (16*b* and 16*a*, respectively) by one or more transverse walls (18) connected to the rotor (2) and extending inwardly toward and penetrating into the liquid annulus space (15), and by planar liquid jets (31) which are deflected from the rotating liquid annulus in the space (15) therefor by means of at least one blade (22) which is fixedly anchored in the pump housing (1) and extends axially along the liquid annulus space (15), a plurality of outflow ports (19) being disposed in a side wall portion (5') which defines the channel (14), and that this side wall portion (5') abuts with a plane slide surface against a surface (26) fixedly connected to the inside of the pump housing (1) and serving as a stationary valve slide.

10. The rotary compressor as claimed in claim 9, characterised in that the surface which serves as a valve slide is operative to close the ports (19) during the compression phases of the compressor and to open said ports on termination of the compression phases in order to permit discharge of compressed gas.

11. The rotary compressor as claimed in claim 9, characterised in that the rotor (2) accommodates at least one central cavity (10) with a central inlet opening (11), the central cavity (10) being connected to the annular gas space (16) by means of at least one suction opening (21).

12. A rotary compressor for a gas and liquid mixture and comprising a disk-like rotor (2) disposed in a fixed pump housing (1) and having an annular peripheral gas and liquid channel (14), characterized in that the channel (14) includes an annular radially outer space (15) for an entrapped liquid annulus and a radially inner, concentric annular space (16) for gas, which is defined by a liquid trap-forming side wall (17) which penetrates into the liquid annulus space (15); and that the gas space (16) is divided into suction and compression chambers (16*b* and 16*a*, respectively) by one or more transverse walls (18) connected to the rotor (2) and extending inwardly toward and penetrating into the liquid annulus space (15), and by planar liquid jets (31) which are deflected from the rotating liquid annulus in the space (15) therefor by means of at least one blade (22) which is fixedly anchored in the pump housing (1) and extends axially along the liquid annulus space (15), said gas space (16) being radially inwardly as defined by a rotor circumferential wall (7) which has radial pitch from the inlet orifice (21) to a point where desired compression ratio is attained, and which, from this point to the transverse wall (18) has a constant radius.

13. A rotary compressor for a gas and liquid mixture and comprising a disk-like rotor (2) disposed in a fixed pump housing (1) and having an annular peripheral gas and liquid channel (14), characterised in that the channel (14) includes an annular radially outer space (15) for an entrapped liquid annulus and a radially inner, concentric annular space (16) for gas, which is defined by a liquid trap-forming side wall (17) which penetrates into the liquid annulus space (15); and that the gas space (16) is divided into suction and compression chambers (16*b* and 16*a*, respectively) by one or more transverse walls (18) connected to the rotor (2) and extending inwardly toward and penetrating into the liquid annulus space (15), and by planar liquid jets (31) which are deflected from the rotating liquid annulus in the space (15) therefor by means of at least one blade (22) which is fixedly anchored in the pump housing (1) and extends axially along the liquid annulus space (15), said rotor (2) having a circumferential wall (7) which is surrounded by a trough-like wall construction (14) which, about the circumferential wall of the rotor, defines said gas and liquid channel; that the circumferential wall (7) has at least one orifice (21; 21*a*; 21*b*) and surrounds a cavity (10) in the rotor, which cavity is connected to an inlet (11,12) for the gas and liquid mixture; that the pump housing (1) supports at least one deflector member (22) which is located in the liquid annulus space (15) and is disposed to deflect, from the liquid annulus rotating with the rotor, a stationary liquid jet (31) towards said rotor circumferential wall (7) which, in its turn, is operative to deflect the jet back to the liquid annulus in a tangential direction; and that said circumferential wall supports at least one transverse radially outwardly projecting wall (18) which projects into the liquid annulus and is disposed, together with said jet (31) and the side walls of the trough-like construction (14), to divide up the gas space (16) into a compression chamber (16*a*) and a suction chamber (16*b*), whose volumes alternatingly are increased and reduced between zero and a maximum, during the rotation of the rotor, the radially projecting transverse wall (18) being disposed to pass radially inside the deflector member (22) and, after gas compression phases, through the liquid jet (31); that the rotor is provided with means (19) for maintaining constant the liquid level in the liquid annulus; and that the compressor has means (19, 26, 29, 29', 21*b*, 42, 43, 44) for leading compressed gas out from the compression chamber (16*a*).

14. The rotary compressor as claimed in claim 13, characterised in that the cavity (10) in the rotor is divided by means of a central, transverse rotor partition (41), into two axially spaced chambers (10*a*, 10*b*) which form a first (10*a*) and a second (10*b*) chamber, of which the first chamber (10*a*) is connected to the inlet (11, 12) for gas and liquid mixture, while the second rotor chamber (10*b*) is connected to an outlet (44) for compressed gas; that the first orifice (21*a*) is disposed in said circumferential wall (7) in that half located in register with the first chamber (10*a*) for leading gas and liquid mixture from the first chamber (10*a*) to the gas and liquid channel which surrounds the circumferential wall (7), while the second orifice (21*b*) is disposed in register with the second chamber (10*b*) in a corresponding half of the circumferential wall (7); that both of the orifices (21*a*, 21*b*) are disposed on either side of the radially projecting transverse wall (18) connected to the circumferential wall (7), such that both orifices (21*a* and 21*b*) are spaced apart at the outer side of the circumferential wall (7) by means of the radially projecting, transverse wall, and are axially spaced apart at the inside of the circumferential wall (7) by means of the transverse partition (41) which separates the first chamber from the second chamber (10*a*, 10*b*, respectively), so that a gas and liquid mixture is sucked into a suction chamber (16*b*) from the first rotor chamber (10*a*), at the same time as compressed gas is forced from a compression chamber (16*a*) to the second rotor chamber (10*b*) during rotation of the rotor.

15. The rotary compressor as claimed in claim 13, characterised in that said wall construction (14) which, about the circumferential wall (7) of said rotor, defines said gas and liquid channel, displays means forming a rotary valve member with valve ports (19) which lead from said gas and liquid channel and discharge at a stationary valve planar surface (26) which is supported by the pump housing and is disposed alternatingly to open and close the valve ports (19) during rotation of the rotor, so that the valve ports are opened for discharging compressed gas during the termination of each compression phase and thereafter are closed by the valve planar surface (26).

16. A rotary compressor comprising a stationary housing and a rotor mounted for rotation in said housing about an axis, said rotor having a wall structure which encloses a central cavity (10) and forms an annular trough (14) which surrounds said cavity and comprises spaced apart side walls and top and bottom walls connecting said side walls and enclosing an annular cavity, said annular cavity being concentric to said axis of the rotor, and inlet means for feeding a mixture of gas and liquid into said central cavity, means (21) forming a communication between said central cavity and said annular trough, means (3) for rotating said rotor and thereby inducing centrifugal forces for throwing gas and liquid from said central cavity into said annular cavity and forming in a radially outer portion of the annular cavity a liquid annulus (15) which will rotate together with the trough, said liquid annulus and said circumferential bottom wall of said trough defining therebetween an annular gas space when said rotor is rotated, wherein said housing (1) has at least one stationary deflector member (22) supported by the housing in a stationary position in said rotating liquid annulus (15) to deflect therefrom a stationary liquid jet (31) towards said circumferential bottom wall (7) which is formed to deflect said liquid jet back to the liquid annulus in a tangential direction, at least one transversal wall member (18) being supported by said circumferential bottom wall and projecting radially outwardly therefrom into said rotating liquid annulus, said transversal wall member, said liquid jet (31) and said side walls dividing said annular gas space (16) into a compression chamber (16*a*) and a suction chamber (16*b*) on either side of said transversal wall member, said compression and suction chambers, as a result of the movement of said transverse wall in relation to said liquid jet when the rotor is rotated, being increased and decreased in volume to work alternatingly as compression and suction chambers, said communication between said central space and said annular space being arranged to be separated by said stationary liquid jet from that chamber which serves as a compression chamber substantially simultaneously as the chamber which is to serve as a suction chamber is connected by means of said communication to said central space, and wherein said rotor and said housing comprise cooperating means for connecting the compression chamber to a receiving means for compressed gas.

* * * * *